US006790071B2

(12) United States Patent
Uezono

(10) Patent No.: US 6,790,071 B2
(45) Date of Patent: Sep. 14, 2004

(54) PRESS CONTACT TERMINAL AND ELECTIC CONNECTION BOX USING THE PRESS CONTACT TERMINAL

(75) Inventor: Koichi Uezono, Ogasa-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/448,006

(22) Filed: May 30, 2003

(65) Prior Publication Data

US 2004/0005807 A1 Jan. 8, 2004

(30) Foreign Application Priority Data

Jul. 2, 2002 (JP) ..... 2002-193334

(51) Int. Cl.[7] ..... H01R 4/24
(52) U.S. Cl. ..... 439/404; 439/475; 439/488
(58) Field of Search ..... 439/395–404, 439/488, 475; 29/874

(56) References Cited

U.S. PATENT DOCUMENTS

| | | | | | |
|---|---|---|---|---|---|
| 4,513,499 | A | * | 4/1985 | Roldan | 29/874 |
| 6,163,460 | A | * | 12/2000 | Baur et al. | 361/752 |
| 6,422,878 | B1 | * | 7/2002 | Pape et al. | 439/78 |
| 6,442,834 | B1 | * | 9/2002 | Takahashi | 29/874 |
| 6,494,723 | B2 | * | 12/2002 | Yamane et al. | 439/404 |
| 6,612,880 | B2 | * | 9/2003 | Arnett et al. | 439/404 |

* cited by examiner

*Primary Examiner*—Renee Luebke
*Assistant Examiner*—Briggitte R. Hammond
(74) *Attorney, Agent, or Firm*—Oblon, Spivak, McClelland, Maier & Neustadt, P.C.

(57) ABSTRACT

A press contact terminal has a press contact blade portion pressed on an electric wire, a pair of tab portions arranged mutually in opposite directions with the press contact blade portion as a middle position, and a middle connection portion that connects the pair of tab portions to the press contact blade portion.

7 Claims, 8 Drawing Sheets

PRESS CONTACT TERMINAL AND ELECTIC CONNECTION BOX USING THE PRESS CONTACT TERMINAL

BACKGROUND OF THE INVENTION

1. Field of the Invention

The present invention relates to a press contact terminal which is pressed on an electric wire arranged on a wiring board and having a tab portion erecting from the wiring board, and relates to an electric connection box using the press contact terminal.

2. Description of the Related Art

FIG. 1 shows an example of a press contact terminal 1 of a related art. The press contact terminal 1 is comprised of a press contact blade portion 2 having an electric-wire slit 2*a* and a tab portion 3 being formed integrally with the upper portion of the press contact blade portion 2 and extended in a linear shape.

FIG. 2 shows an example of a wiring board 5 of a related art. The wiring board 5 has many terminal fitting grooves 6 formed in parallel with a top and bottom surfaces and electric wires 7 are inserted in the electric-wire slits 2*a* of the terminals 1 fitted in the terminal fitting grooves 6, respectively.

When the press contact blade portion 2 of the press contact terminal 1 is inserted into the terminal fitting groove 6 of the wiring board 5, a conducting wire 7*a* of the electric wire 7 inserted into the electric-wire slit 2*a* is pressed on the press contact blade portion 2 and the press contact terminal 1 is fixed in the terminal fitting groove 6. The tab portion 3 of the fixed press contact terminal 1 is erected from the wiring board 5.

SUMMARY OF THE INVENTION

In the related art, however, the tab portion 3 can be erected only from the same surface of the wiring board 5 where the electric wire 7 is laid. Thus, in a case where the tab portions 3 to be connected to the same electric wire 7 are required to be erected from both of the top and bottom surfaces of the wiring board 5, it is necessary to lay the electric wire 7 on both surfaces of the wiring board 5 and to erect the press contact terminals 1 on both of the top and bottom surfaces thereof. Thus, this increases the number of parts because two presses contact terminals 1 need to be used for the top and bottom surfaces.

There is another method to prepare a press contact terminal having a tab portion to be erected from a surface opposite to the surface of the wiring board 5 where the electric wire 7 is laid. However, this method needs to make two kinds of press contact terminals and therefore the manufacturing cost of the terminal is increased (in particular, manufacturing cost of a die).

The present invention has been made to solve the above problem. It is the object of the present invention to provide a press contact terminal that can reduce the manufacturing cost of the press contact terminal and the number of parts in a case where tab portions are erected from the same and opposite surfaces of the surface of a wiring board where electric wires are laid, and an electric connection box using the press contact terminals.

In order to solve the foregoing problem, according to the first aspect of the present invention, there is provided a press contact terminal comprising: a press contact blade portion pressed on an electric wire; a pair of tab portions being extended mutually in opposite directions with the press contact blade portion as a middle position; and a middle connection portion connecting the pair of tab portions to the press contact blade portion.

DETAILED DESCRIPTION OF THE INVENTION

One preferred embodiment of the present invention will be described below based on accompanying drawings.

Figure 1:
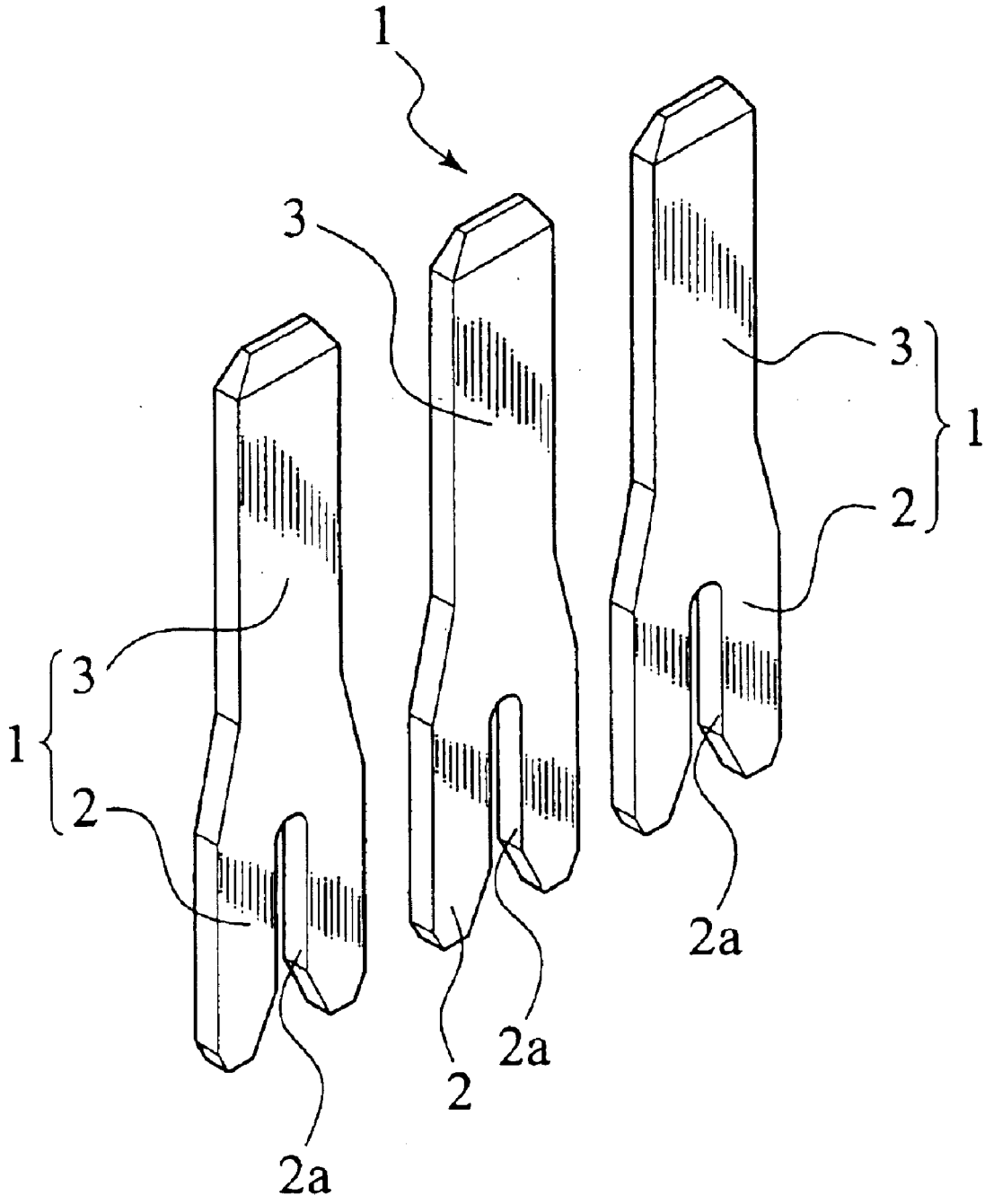
FIG. 1 PRIOR ART
FIG. 1 is a perspective view of a press contact terminal of a related art.
Figure 2:
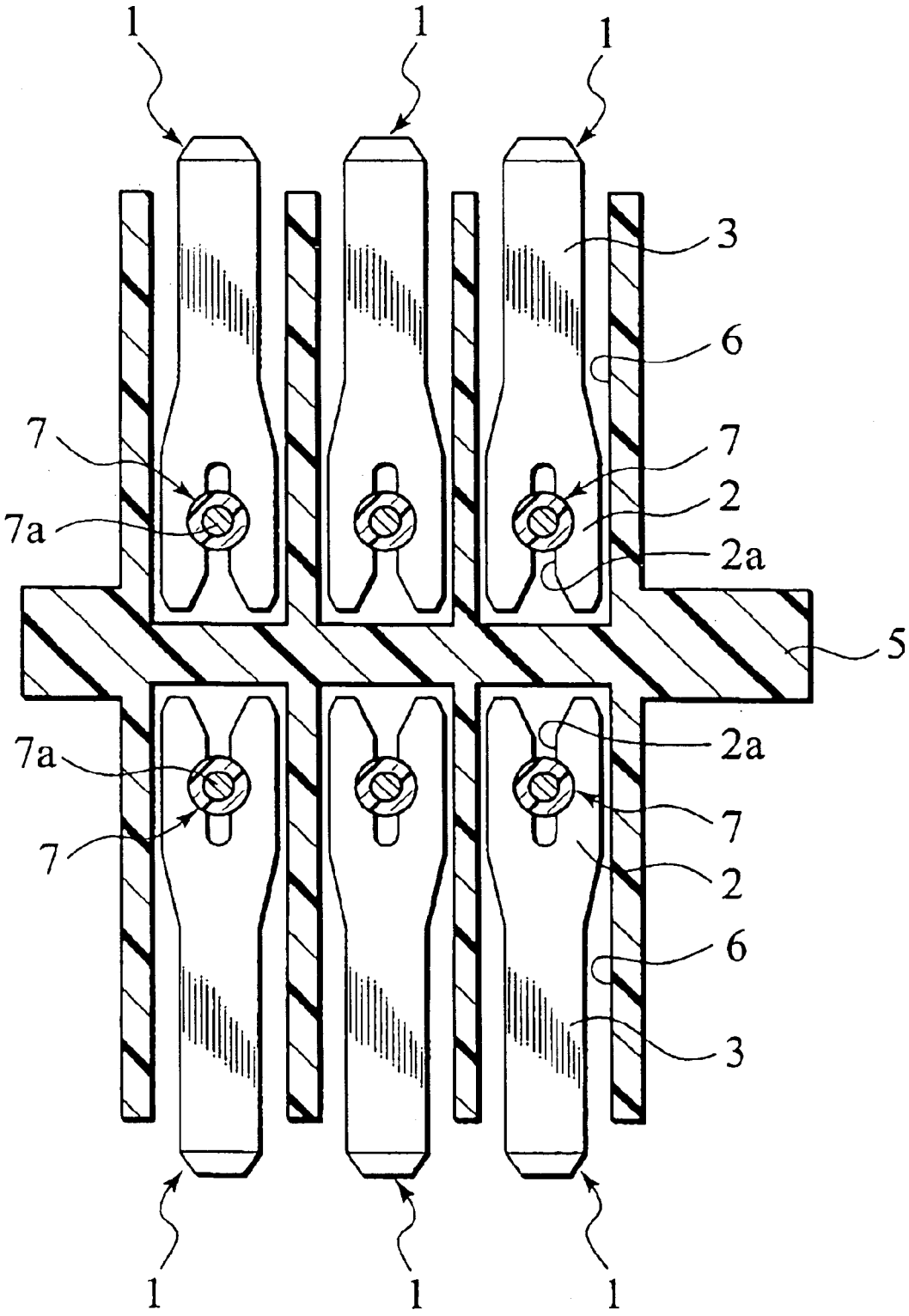
FIG. 2 PRIOR ART
FIG. 2 is a cross-sectional view showing a wiring board mounted with press contact terminals of a related art.
Figure 3A:
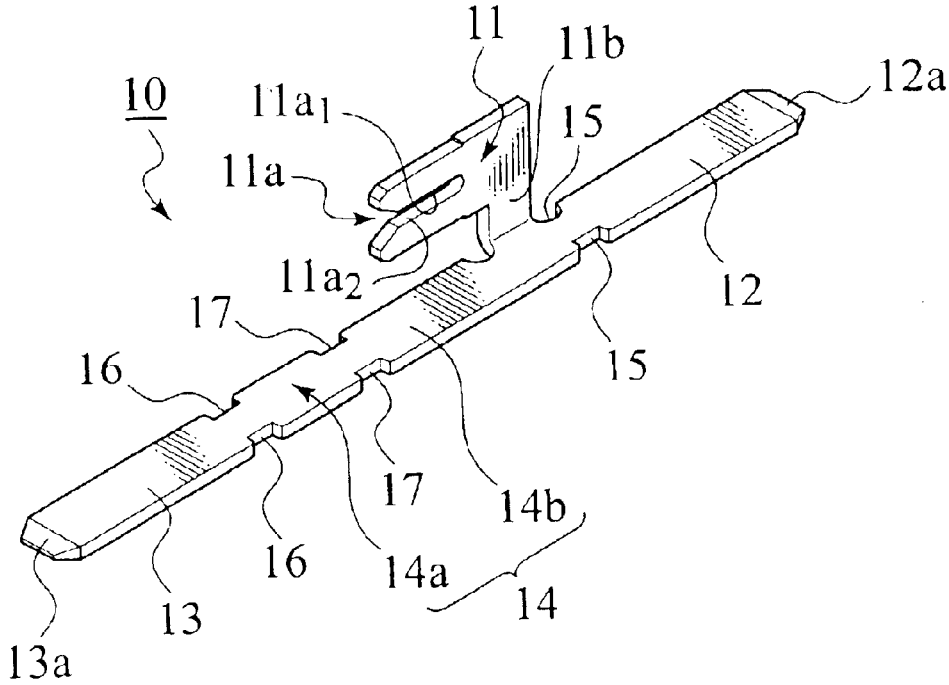
FIG. 3A is a perspective view of a press contact terminal.
Figure 3B:
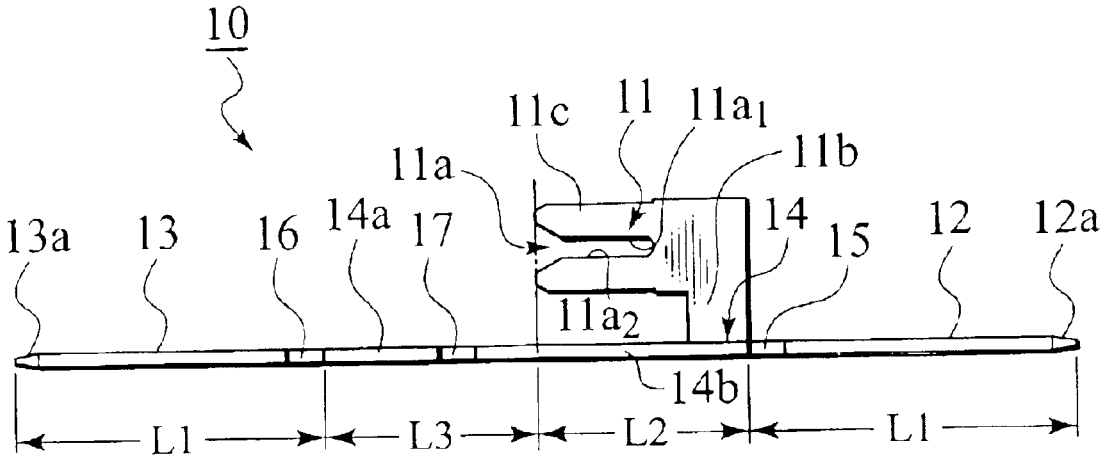
FIG. 3B is a side view of the press contact terminal.
Figure 4:
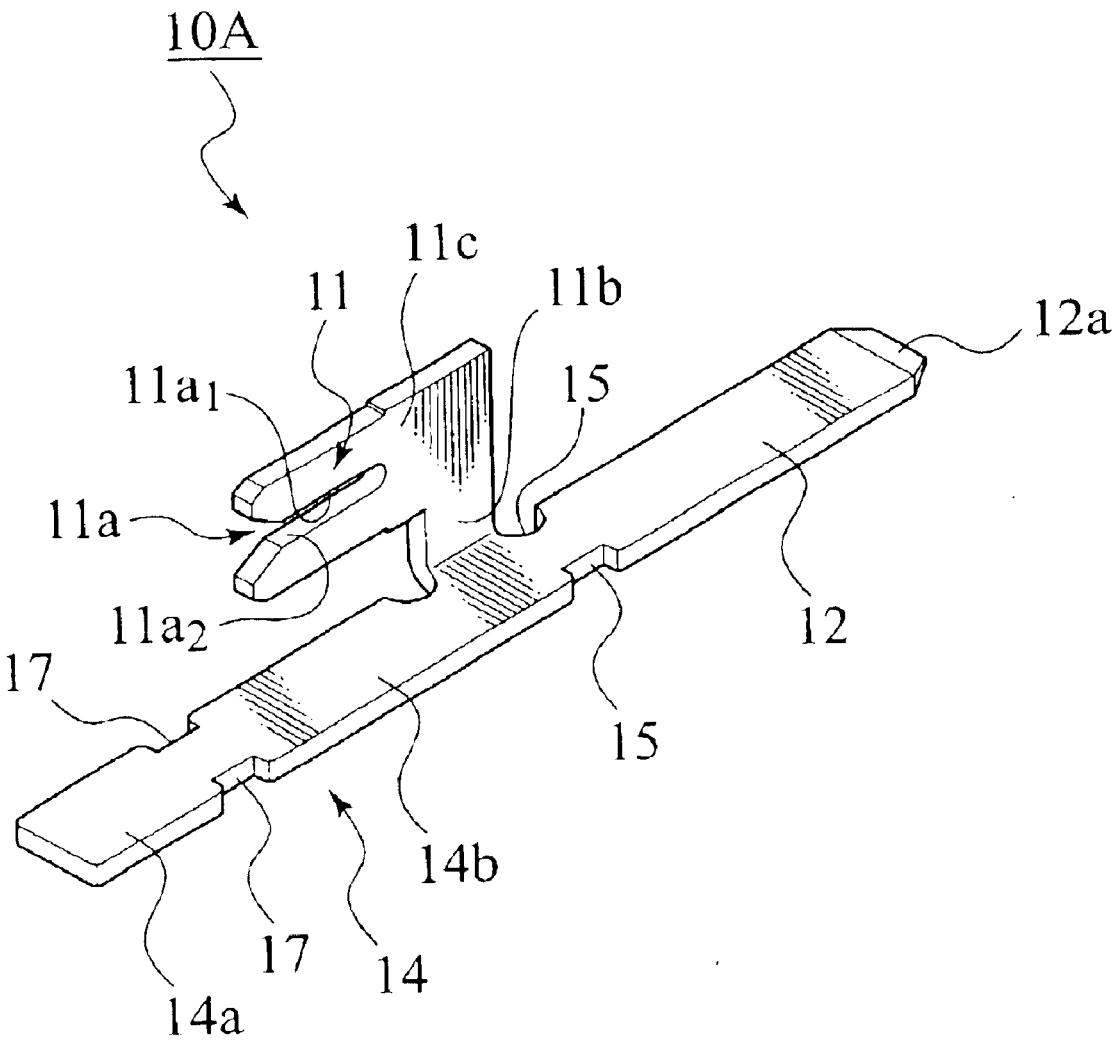
FIG. 4 shows one embodiment of the present invention and is a perspective view of the press contact terminal in which one tab portion is cut such that only the other tab is mounted on the same surface as an electric wire.
Figure 5:
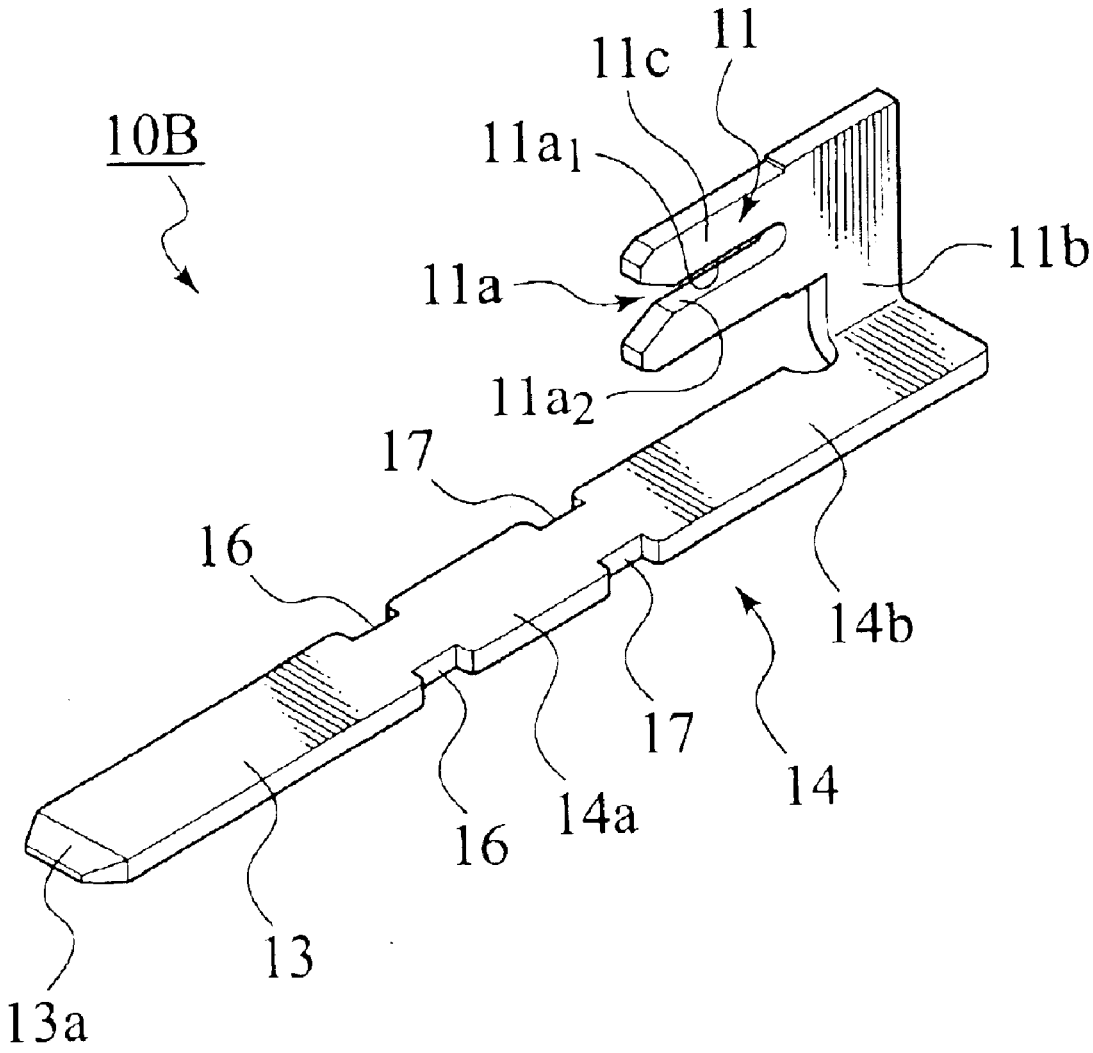
FIG. 5 shows one embodiment of the present invention and is a perspective view of the press contact terminal in which one tab portion is cut such that only the other tab is erected from a surface opposite to the electric wire.
Figure 6:
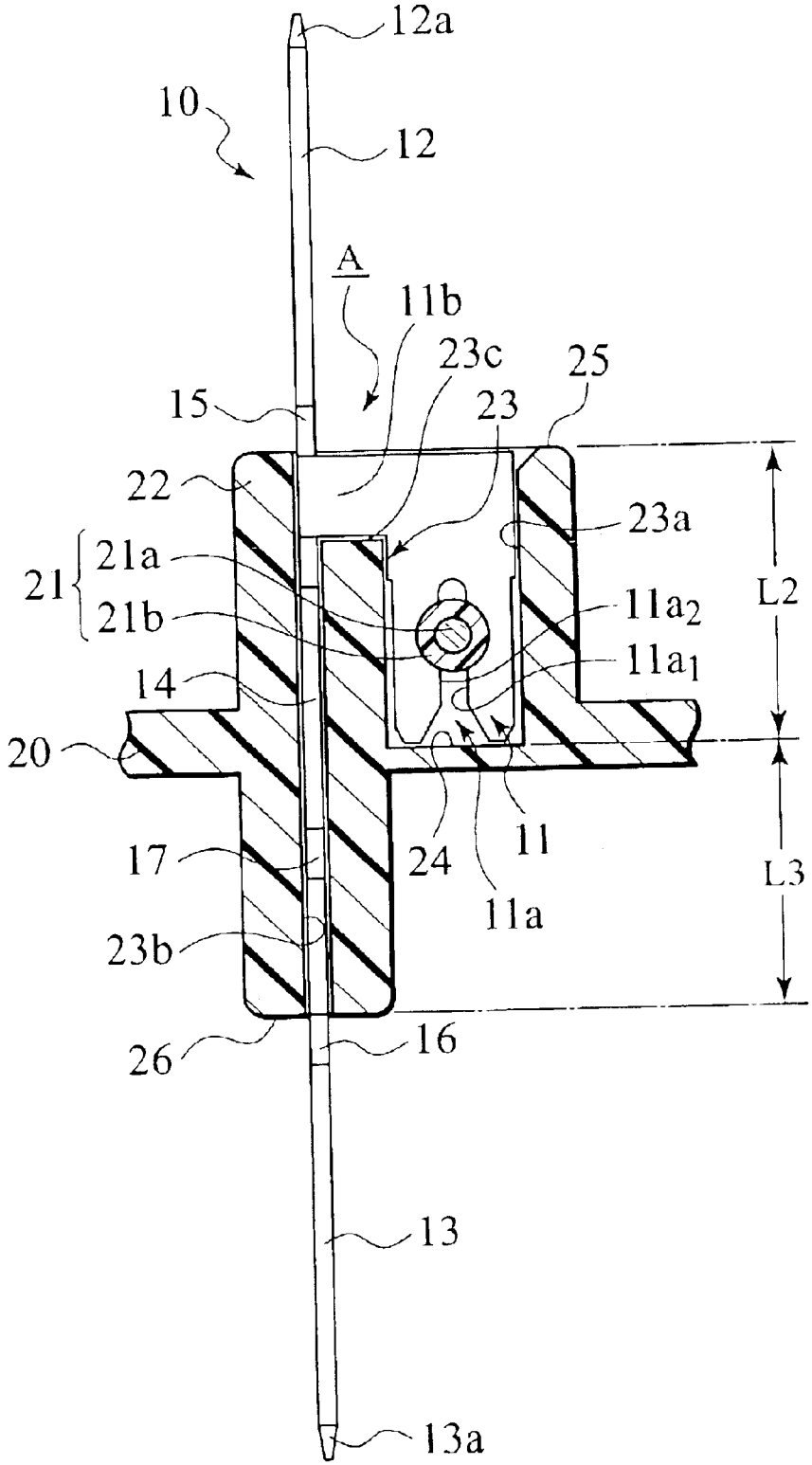
FIG. 6 shows one embodiment of the present invention and is a cross-sectional view showing a state where the press contact terminal having both tab portions erected from the wiring board.
Figure 7:
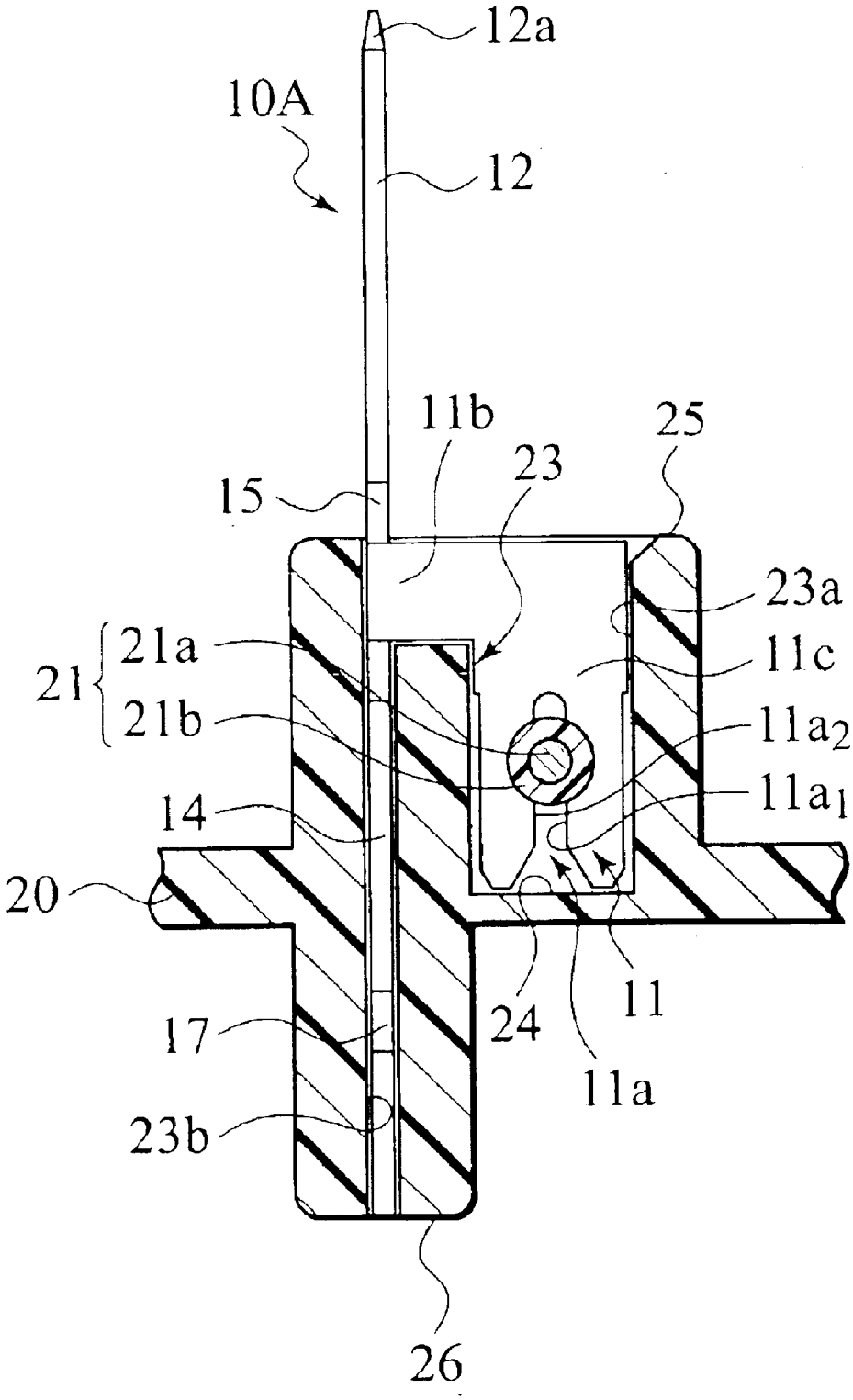
FIG. 7 shows one embodiment of the present invention and is a cross-sectional view showing a state where the press contacts terminal having only one tab portion erected from the wiring board.
Figure 8:
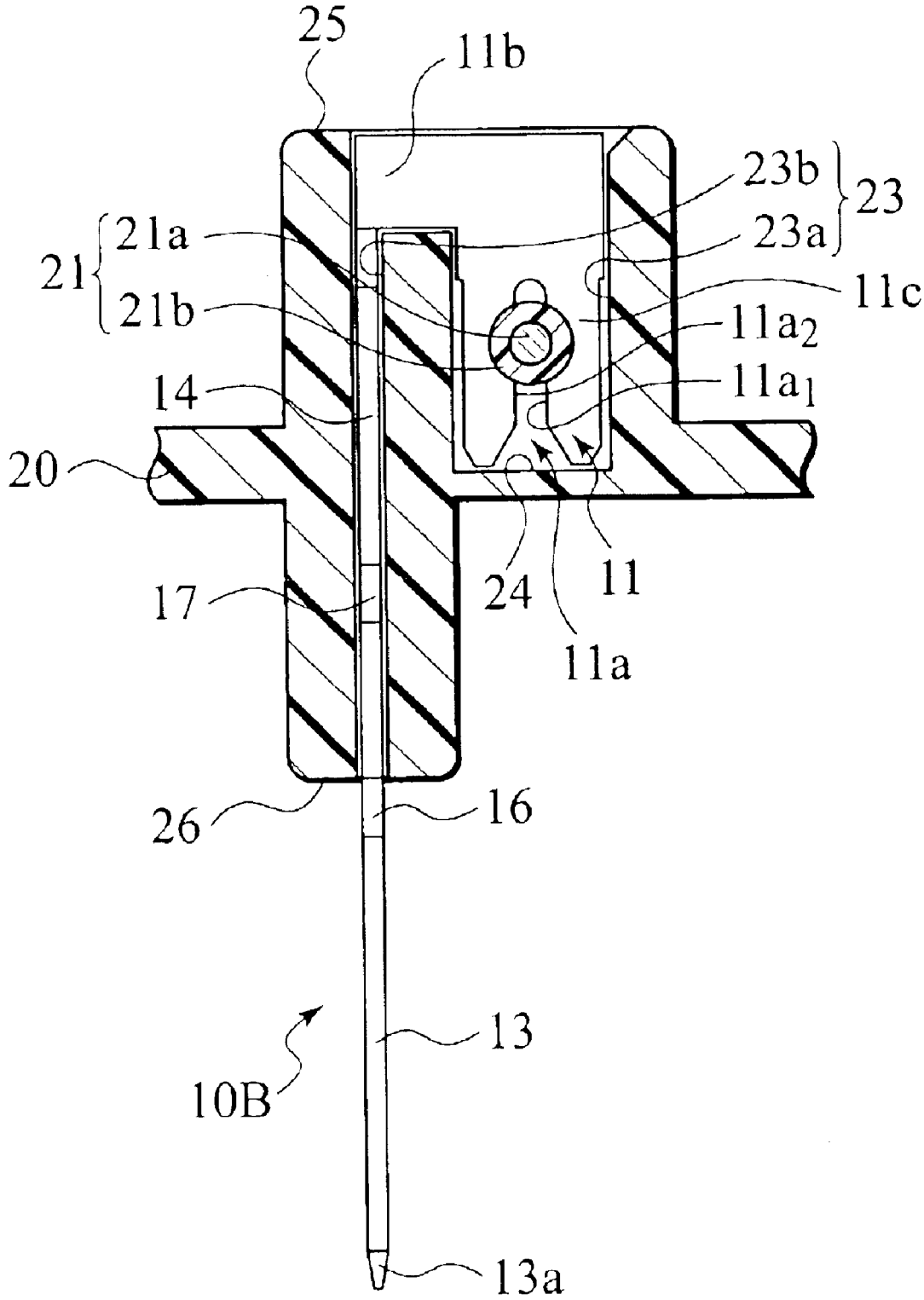
FIG. 8 shows one embodiment of the present invention and is a cross-sectional view showing a state where the press contact terminal having only the other tab portion is mounted on the wiring board.

FIGS. 3A to 8 show one embodiment of the present invention. FIG. 3A shows a perspective view of a press contact terminal. FIG. 3B shows a side view of the press contact terminal. FIG. 4 shows a perspective view of the press contact terminal in which one tab portion is cut such that only the other tab is erected from the same surface as an electric wire. FIG. 5 shows a perspective view of the press contact terminal in which one tab portion is cut such that only the other tab is erected from a surface opposite to the electric wire. FIG. 6 shows a cross-sectional view showing a state where the press contact terminal having both tab portions is erected from the wiring board. FIG. 7 shows a cross-sectional view showing a state where the press contacts terminal having only one tab portion is erected from the wiring board. FIG. 8 is a cross-sectional view showing a state where the press contact terminal having only the other tab portion is erected from the wiring board.

As shown in FIGS. 3A and 3B, the press contact terminal 10 is comprised of a press contact blade portion 11 pressed on an electric wire 21 (see FIG. 6), a pair of tab portions 12, 13 extending mutually in opposite directions with the press contact blade portion 11 as a midpoint, and a middle connection portion 14 connects the pair of tab portions 12, 13 to the press contact blade portion 11. The press contact terminal 10 is integrally formed by the use of a die.

The press contact blade portion 11 is roughly constructed of an erect portion 11*b* erecting from the middle connection portion 14 and a horizontal portion 11*c* that extends nearly in parallel to the middle connection portion 14 from the erect portion 11*b*, and is approximately L-shaped. Moreover, an electric-wire slit 11*a* is formed at the end of the horizontal portion 11*c*, and the insides 11$a_1$, 11$a_2$, opposite to each other, of the electric-wire slit 11*a* each are shaped like an edge.

As shown in FIG. 3A, the middle connection portion 14 is comprised of a first portion 14*a* and a second portion 14*b*. The erect portion 11*b* is formed integrally with the second portion 14*b* of the middle connection portion 14.

The tab portion 12 is aligned with the tab portion 13 via the middle connection portion 14 and tip portions of the tab portions 12, 13 are formed into tapering faces 12*a*, 13*a*, respectively. The respective tab portions 12, 13 have the same length L1. At each of the boundaries of the respective tab portions 12, 13 and the middle connection portion 14, a pair of first cutting grooves (weakened portions) as cutting marks 15, 15 or 16, 16 is formed on the end of each of the tab portions 12, 13.

The erect portion 11*b* is formed at right angle on the second portion 14*b* of the middle connection portion 14. With this construction, the press contacts blade portion 11 and the pair of tab portions 12, 13 are arranged at right angle to each other. Moreover, the length of the middle connection portion 14 is set in such a way that in a case where the press contact blade portion 11 is pressed onto the electric wire 21 arranged on a wiring board 20, the pair of tab portions 12, 13 protrude from the respective tab protrusion base planes 25, 26 on both surfaces of the wiring board 20.

As shown in FIG. 3B, the horizontal portion 11*c* of the press contact blade portion 11's length is L2 and the middle connection portion 14's length is (L2+L3). The length from one base plane 25 of a connection box A, which will be described later, to the other base plane 26 thereof is set in such a way that it is equal to the total length of (L2+L3) of the middle connection portion 14 (see FIGS. 6, 7, 8).

Moreover, on the end of the middle connection portion 14 are formed a pair of second cutting grooves (weakened portions) 17, 17 as cutting marks indicating the cutting position of the tab portion 13. The tab portion 13 is to be erected from a side opposite to the press contact blade portion 11 (the side of the first portion 14*a* of the middle connection portion 14) in a case where the press contact blade portion 11 is pressed on the electric wire 21 arranged on the wiring board 20.

As shown in FIGS. 6 to 8, the wiring board 20 is built in the main connection box A of an electric connection box. The wiring board 20 has many electronic components (not shown) mounted thereon and has electric wires 21 laid thereon to form a predetermined circuit. This wiring board 20 has terminal mounting portions 22 and terminal fitting grooves 23 are formed in the terminal mounting portions 22, respectively.

The terminal fitting groove 23 is comprised of a blade fitting groove 23*a* in which the horizontal portion 11*c* of the press contact blade portion 11 is fitted, a contact surface 23*c* against which the erect portion 11*b* of the press contact blade portion 11 abuts, and a middle connection through hole 23*b* in which the middle connection portion 14 is fitted. The blade fitting groove 23*a* is open in the top surface of the wiring board 20 and its bottom surface is the fitting base surface 24 of the press contact terminal 10. In addition to the fitting base surface 24, there is provided the contact surface 23*c*, so that the contact terminal 10 can be surely fitted in the connection box A.

The middle connection through hole 23*b* comprises a opening in the top and bottom surface of the terminal mounting portion 22 and the top and bottom surfaces of the terminal mounting portion 22 perform as tab protrusion base surfaces 25, 26. Then, a length from the fitting base surface 24 to the upper tab protrusion base surface 25 is set at L2 and a length from the fitting base surface 24 to the lower protrusion base surface 26 is set at L3, respectively. The length of the middle connection portion 14 equal to L2+L3.

The electric wire 21 is comprised of a conducting wire 21*a* and an insulator 21*b* covering the outer periphery of the conducting wire 21*a* and is laid on the wiring board 20.

Next, a work of mounting the press contact terminal 10 on the wiring board 20 will be described.

As shown in FIG. 6, in a case where the tab portions 12, 13 are mounted on both surfaces of the wiring board 20, as shown in FIGS. 3A, 3B, in this case the press contact terminal 10 is used.

As shown in FIG. 6, when the press contact terminal 10 is inserted, from the press contact blade 11 side, into the terminal fitting groove 23 of the wiring board 20, the insulator 21*b* of the conducting wire 21 inserted into the electric-wire slit 11*a* is cut and the conducting wire 21*a* is pressed on the press contact blade portion 11 and the lower tab portion 13 is protruded downward from the middle connection fitting groove 23*b*.

Then, the press contact blade portion 11 of the press contact terminal 10 is fitted in the blade fitting groove 23*a* and the middle connection portion 14 is fitted in the middle connection fitting groove 23*b*. In this manner, the tab portions 12, 13 conducting to the same electric wire 21 can be erected from the top and bottom surfaces of the wiring board 20.

As shown in FIG. 4, in a case where the tab portion 12 is erected from the same surface as the electric wire 21, that is, only on the top surface, of the wiring board 20, a press contact terminal 10A is used which is made by cutting the press contact terminal 10 along the first cutting groove 16 to cut off the tab portion 13. In this respect, it is also recommended that the press contact terminal 10 be cut at the second cutting grove 17. The press contact terminal 10A is fitted in the terminal fitting groove 23 of the wiring board 20 in the same manner as described above. In this manner, as shown in FIG. 7, the tab portion 12 conducting to the electric wire 21 can be erected only from the top surface of the wiring board 20.

In a case where the tab portion 13 is erected from the surface opposite to the electric wire 21, that is, only on the bottom surface, of the wiring board 20, as shown in FIG. 5, a press contact terminal 10B is used that is made by cutting the press contact terminal 10 along the first cutting groove 15 to cut off the tab portion 12. This press contact terminal 10B is fitted in the terminal fitting groove 23 of the wiring board 20 in the same manner as described above. In this manner, as shown in FIG. 8, the tab portion 13 conducting to the electric wire 21 can be erected only from the bottom surface of the wiring board 20.

As described above, the tab portions 12, 13 can be protruded from both surfaces of the wiring board 20 by one press contact terminal 10. Thus, it is possible to reduce the manufacturing cost of the terminal and the number of parts.

Thus, the press contact terminal 10 can be used in three patterns or cases, that is, 1) in a case where both of the tab portions 12, 13 are used, 2) in a case where only the tab portion 12 on the same surface as the electric wire 21, and 3) in a case where on the tab portion 13 on the surface opposite to the electric wire 21.

In the embodiment described above, the lengths L2, L3 of the middle connection portion 14 are set in such a manner that in a case where the press contact blade portion 11 is pressed on the electric wire 21 arranged on the wiring board 20, the pair of tab portions 12, 13 protrude from the respective tab protrusion base faces 25, 26 of both surfaces of the wiring board 20. Thus, only the respective tab portions 12, 13 protrude from the wiring board 20. For this reason, it is possible to correctly set the protrusion-length of the tab portions 12, 13. Moreover, it is possible to make an easy check of incomplete insertion of the press contact terminal 10 by the use of the pair of first cutting grooves 15, 16. In other words, the agreement of the pair of first cutting grooves 15, 16 with the positions of the tab protrusion base surfaces 25, 26 shows a complete-insertion-state, and contrarily the protrusion of the pair of first cutting grooves 15, 16 from the tab protrusion base surfaces 25, 26 shows a incomplete-insertion-state.

Further, the press contact blade portion 11 is arranged at right angle to the tab portions 12, 13, so that the tab portions 12, 13 are inserted in a space next to the electric wire 21 arranged on the wiring board 20 and in parallel to the electric wire 21. For this reason, it is possible to reduce the gap between neighboring electric wires 21 and thus to increase a packing density.

Further, in the embodiment described above, the first cutting grooves 15, 16 as the cutting marks indicating a cutting position are formed at the boundaries of the pair of tab portions 12, 13 and the middle connection portion 14. Thus, when cutting the tab portions 12, 13, it is possible to easily find the portion to be cut. Therefore, it is possible to cut the tab portions 12, 13 with precision and ease.

The middle connection portion 14 is provided with the second cutting grooves 17 as the cutting marks indicating the cutting position of the tab portion 13 that is to be erected from the surface opposite to the press contact blade portion 11 in a case where the press contact blade portion 11 is pressed on the electric wire 21 arranged on the wiring board 20. Thus, when cutting the tab portion 13, it is possible to easily find the portion to be cut. Therefore, it is possible to cut the tab portion 13 with precision and ease.

In particular, the cutting marks are the pair of cutting grooves 15, 15 and 16, 16 and 17, 17 formed on both the ends and the cutting portions are weakened in width as compared with the other portions, so that a cutting work can be easily performed. The cutting marks are not limited to the cutting grooves 15, 16, 17, but it is essential only to recognize them visually.

While the present invention is applied to the press contact terminal 10 mounted on the wiring board 20 in the main connection box A of the electric connection box, needless to say, the present invention can be applied in the same way to objects other than this.

The entire content of a Japanese Application No. P2002-193334 with a filing date of Jul. 2, 2002 is herein incorporated by reference.

Although the invention has been described above by reference to certain embodiments of the present invention, the invention is not limited to the embodiments described above and will occur to those skilled in the art, in light of the teachings. The scope of the invention is defined with reference to the following claims.

What is claimed is:

1. A press contact terminal, comprising:

a press contact blade portion configured to be pressed on an electric wire;

a pair of tab portions extending mutually in opposite directions with the press contact blade portion as a middle position; and a middle connection portion connecting the pair of tab portions to the press contact blade portion, wherein at least a first cutting mark is provided at a boundary between the middle connection portion and one tab portion of said pair of tab portions for selectively separating said one tab portion from said press contact.

2. The press contact terminal of claim 1, wherein an angle between the press contact blade portion and the tab portion is a right angle.

3. The press contact terminal of claim 1, wherein the at least first cutting mark comprises at least a pair of cutting grooves formed in a vicinity of said boundary.

4. An electric connection box comprising:

a main connection box having a wiring board, wherein the press contact terminal as claimed in claim 1 engage the wiring board.

5. The electric connection box of claim 4, wherein a length of the main connection box is equal to a length of the middle connection portion.

6. A press contact terminal, comprising:

a cress contact blade portion configured to be pressed on an electric wire; a pair of tab portions extending mutually in opposite directions with the press contact blade portion as a middle position; and a middle connection portion connecting the pair of tab portions to the press contact blade portion, wherein first cutting marks indicating cutting positions are provided at boundaries of the pair of tab portions and the middle connection portion, and the press contact terminal further comprises a second cutting mark provided between the pair of first cutting marks.

7. The press contact terminal of claim 6, wherein the second cutting mark comprises a pair of cutting grooves formed at a portion of the middle connection portion.

* * * * *

UNITED STATES PATENT AND TRADEMARK OFFICE

CERTIFICATE OF CORRECTION

PATENT NO. : 6,790,071 B2
DATED : September 14, 2004
INVENTOR(S) : Unezono

It is certified that error appears in the above-identified patent and that said Letters Patent is hereby corrected as shown below:

Column 6,
Line 39, change “cress” to -- press --.

Signed and Sealed this

Twenty-second Day of February, 2005

JON W. DUDAS
*Director of the United States Patent and Trademark Office*